US007961070B2

(12) United States Patent
Suzuki et al.

(10) Patent No.: US 7,961,070 B2
(45) Date of Patent: Jun. 14, 2011

(54) INDUCTOR

(75) Inventors: Kotaro Suzuki, Kumagaya (JP); Ryo Nakatsu, Niiza (JP)

(73) Assignee: Tamura Corporation, Nerima-Ku, Tokyo (JP)

( * ) Notice: Subject to any disclaimer, the term of this patent is extended or adjusted under 35 U.S.C. 154(b) by 0 days.

(21) Appl. No.: 12/579,760

(22) Filed: Oct. 15, 2009

(65) Prior Publication Data

US 2010/0102912 A1 Apr. 29, 2010

(30) Foreign Application Priority Data

Oct. 23, 2008 (JP) ..... 2008-273102

(51) Int. Cl.
*H01F 27/06* (2006.01)
*H01F 27/30* (2006.01)
*H01F 27/26* (2006.01)

(52) U.S. Cl. ..... 336/65; 336/67; 336/68; 336/209; 336/210

(58) Field of Classification Search ..... 336/65, 336/67, 68, 209, 210; 439/856
See application file for complete search history.

(56) References Cited

U.S. PATENT DOCUMENTS 3,110,873 A * 11/1963 Mittermaier ..... 336/210
5,489,884 A * 2/1996 Heringer et al. ..... 336/210
2009/0108971 A1 4/2009 Okamoto

FOREIGN PATENT DOCUMENTS

JP 2005072198 A * 3/2005
JP WO2006016554 2/2006
JP WO2007108201 9/2007
JP 2008028288 A * 2/2008
JP WO2008093492 8/2008
JP 2008300786 12/2008
JP 200943929 2/2009
JP 200943930 2/2009

* cited by examiner

*Primary Examiner* — Anh T Mai
*Assistant Examiner* — Tszfung Chan
(74) *Attorney, Agent, or Firm* — Day Pitney LLP

(57) ABSTRACT

An inductor has a case having an opening, a core accommodated in the case, a coil wound on a part of the core and a fixing member fixed to the case. The fixing member fixes the core by contacting a top surface of the core facing the opening and elastically biasing the core toward a bottom surface of the case. The fixing member further includes a first plate portion and a first contacting portion. The first plate portion is disposed between the top surface of the core and the opening of the case and extending in parallel with the top surface of the core. The first contacting portion extends from a fore-end portion of the first plate portion so as to be U-shaped and having a distal end portion elastically push-contacting the top surface of the core.

8 Claims, 5 Drawing Sheets

INDUCTOR

CROSS-REFERENCE TO RELATED APPLICATION

This application claims priority under 35 U.S.C. §119 from Japanese Patent Application No. 2008-273102 filed on Oct. 23, 2008. The entire subject matter of the application is incorporated herein by reference.

BACKGROUND

1.Technical Field

Aspects of the present invention relate to an inductor formed such that a core on which a coil is wound is accommodated in a case.

2.Related Art

Conventionally, an inductor is used as a reactor in an electric circuit. An example of such an inductor (reactor) is disclosed in International Publication No. WO 2007/108201 (hereinafter, referred to as '201 publication).

FIG. 7 is a perspective view showing a configuration of a conventional reactor disclosed in '201 publication. The reactor 101 is configured such that a core 120, which is O-shaped when viewed from directly above, and a pair of coils 130, which are wound around the core 120, are accommodated in a case 110.

A fixing member 140 is used to retain the core 120 in the case 110. FIG. 8 is a perspective view showing the fixing member 140 of the conventional reactor. As shown in FIG. 8, the fixing member 140 is made by bending a metal plate (e.g., a stainless-steel plate) into an L-shape at a corner portion 143. In addition, an opening 145 is formed at a position in the vicinity of one of corners (upper left corner in FIG. 8) of an upper plate 141, which extends from the corner portion 143 in an horizontal direction, in order to fix the fixing member 140 to the case 110 with a bolt 152 inserted through the opening 145 (FIG. 7).

A side plate 142, which extends from the corner portion 143 in an vertical direction, is bended into a U-shape in the middle thereof. The second portion 142 is inserted into a space between an inner surface of a side wall 111, which is one of side walls of the case 110, and the core 120. Thus, the side plate 142 biases the core 120 toward a side wall (not shown in FIG. 7) opposed to the side wall 111.

Furthermore, a slit 144 is formed in the middle of the upper plate 141 of the fixing member 140 (FIG. 8) to divide the upper plate 141 into two parts. One part has the opening 145 as described above, and the other part of which a fore-end portion is bent downwardly and a leaf spring 141*a* is formed. In a state where the fixing member 140 is fixed to the case 110, a fore-end of the leaf spring 141*a* elastically push-contacts a top surface of the core 120 and biases the core 120 toward a bottom surface of the case 110.

As described above, the fixing member 140 retains the core 120 in case 110 by biasing the core 120 toward the side wall and the bottom surface of case 110.

However, in the conventional reactor 101, since the core 120 is biased toward the bottom surface of the case 110 with an elasticity produced by the leaf spring 141*a* itself, a stress concentration is likely to occur on the upper plate 141 of the fixing member 140, in particular, at the end of the slit 144. Therefore, there remain problems that the fixing member 140 may be broken by an excessive stress given to the upper plate 141 due to a big impact load.

SUMMARY

In consideration of the above problems, aspects of the invention provide an improved inductor of which a fixing member is irrefrangible even though an impact load is given to the inductor.

According to aspects of the present invention, there is provided an inductor including a case having an opening, a core accommodated in the case, a coil wound on a part of the core and a fixing member fixed to the case. The fixing member fixes the core by contacting a top surface of the core facing the opening and elastically biasing the core toward a bottom surface of the case. The fixing member further includes a first plate portion and a first contacting portion. The first plate portion is disposed between the top surface of the core and the opening of the case and extending in parallel with the top surface of the core. The first contacting portion extends from a fore-end portion of the first plate portion so as to be U-shaped and having a distal end portion elastically push-contacting the top surface of the core.

BRIEF DESCRIPTION OF THE ACCOMPANYING DRAWINGS

Figure 6:
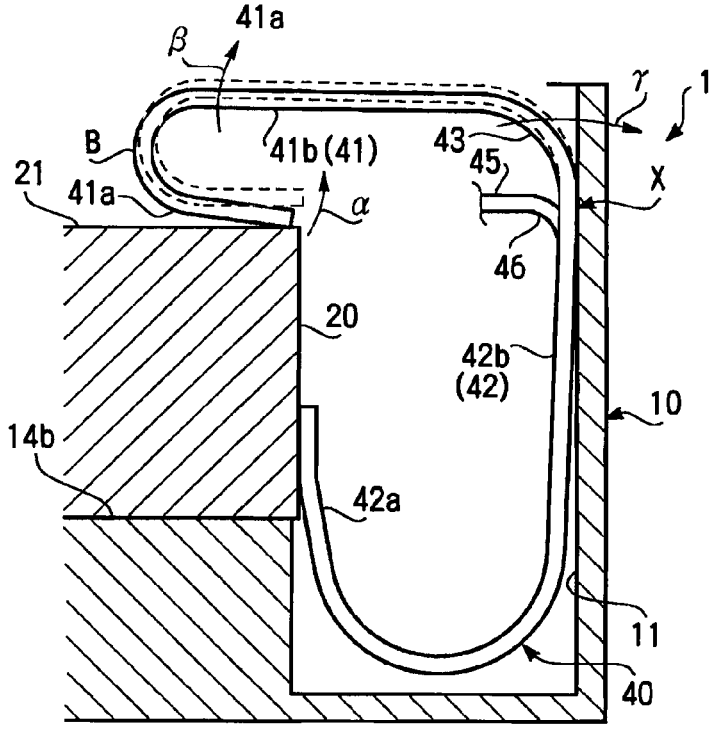

FIG. 6 schematically shows a behavior of the fixing member 40 when an external load is given to the reactor according to the embodiment of the present invention.

Figure 7:
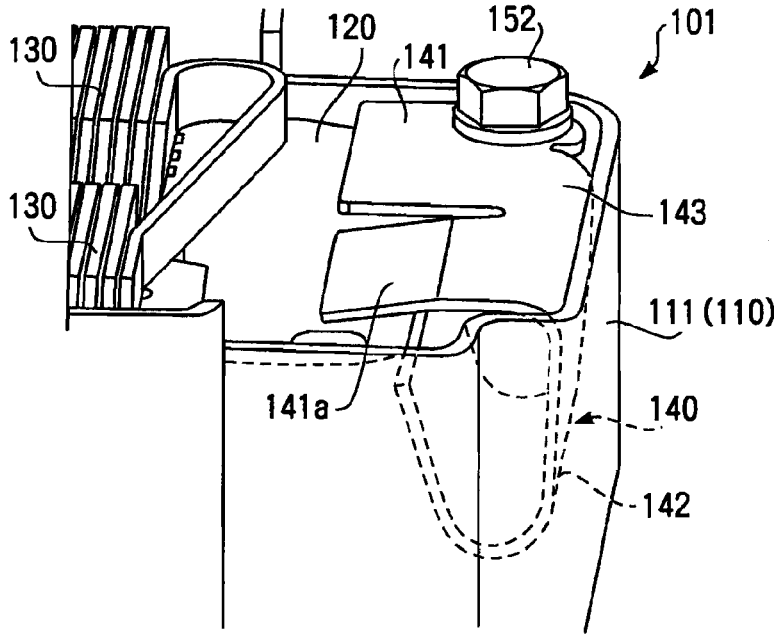
FIG. 7 PRIOR ART

FIG. 7 is a perspective view showing a configuration of a conventional reactor.

Figure 8:
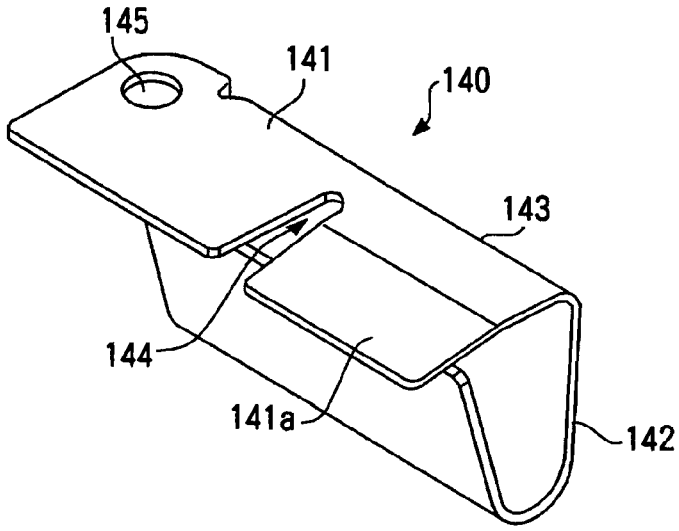
FIG. 8 PRIOR ART

FIG. 8 is a perspective view showing a fixing member 140 of the conventional reactor.

DETAILED DESCRIPTION

Hereinafter, an embodiment according to aspects of the present invention will be described with reference to the accompany drawings.

Figure 1:
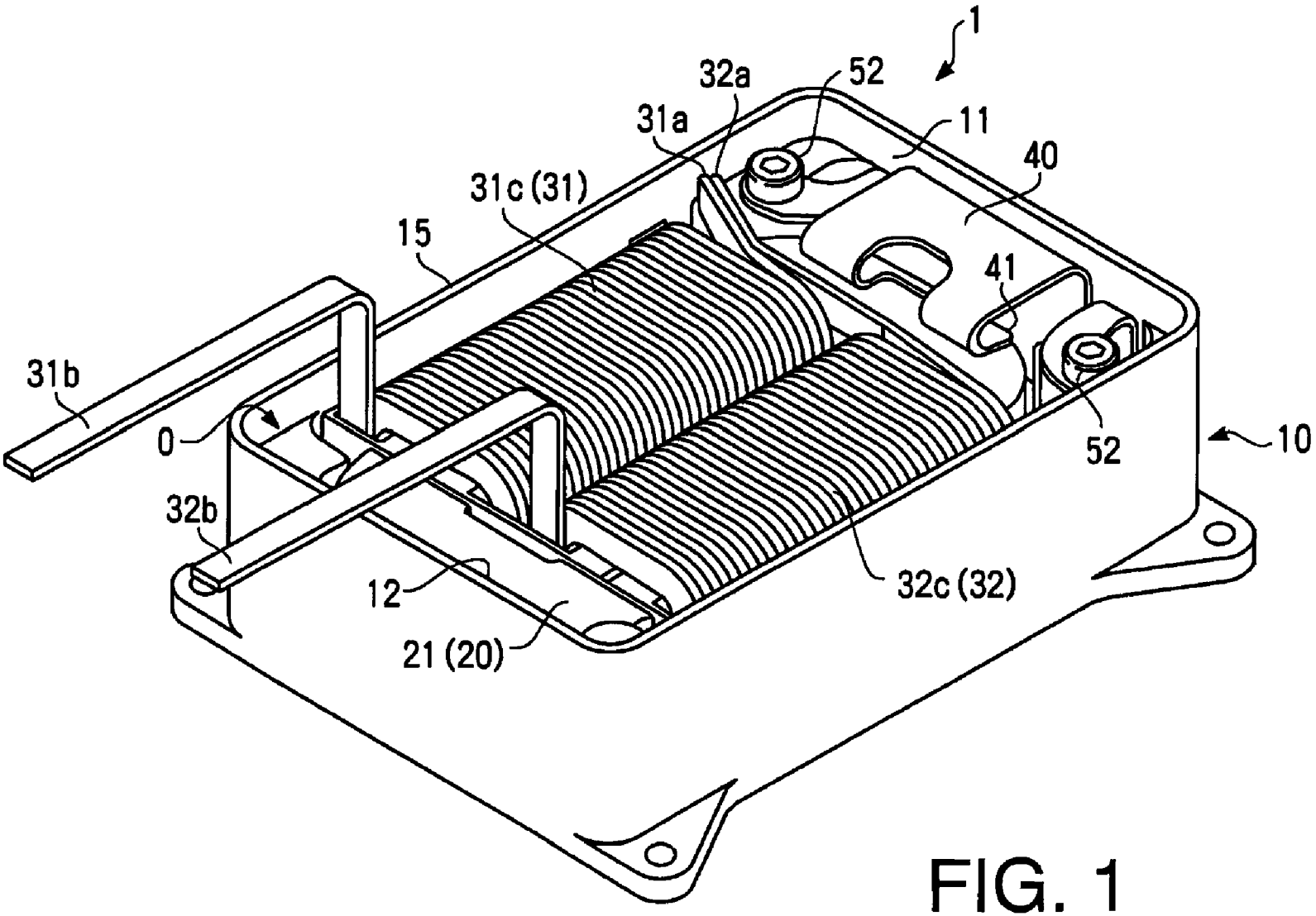
FIG. 1 is a perspective view showing a reactor according to an embodiment of the present invention.
Figure 2:
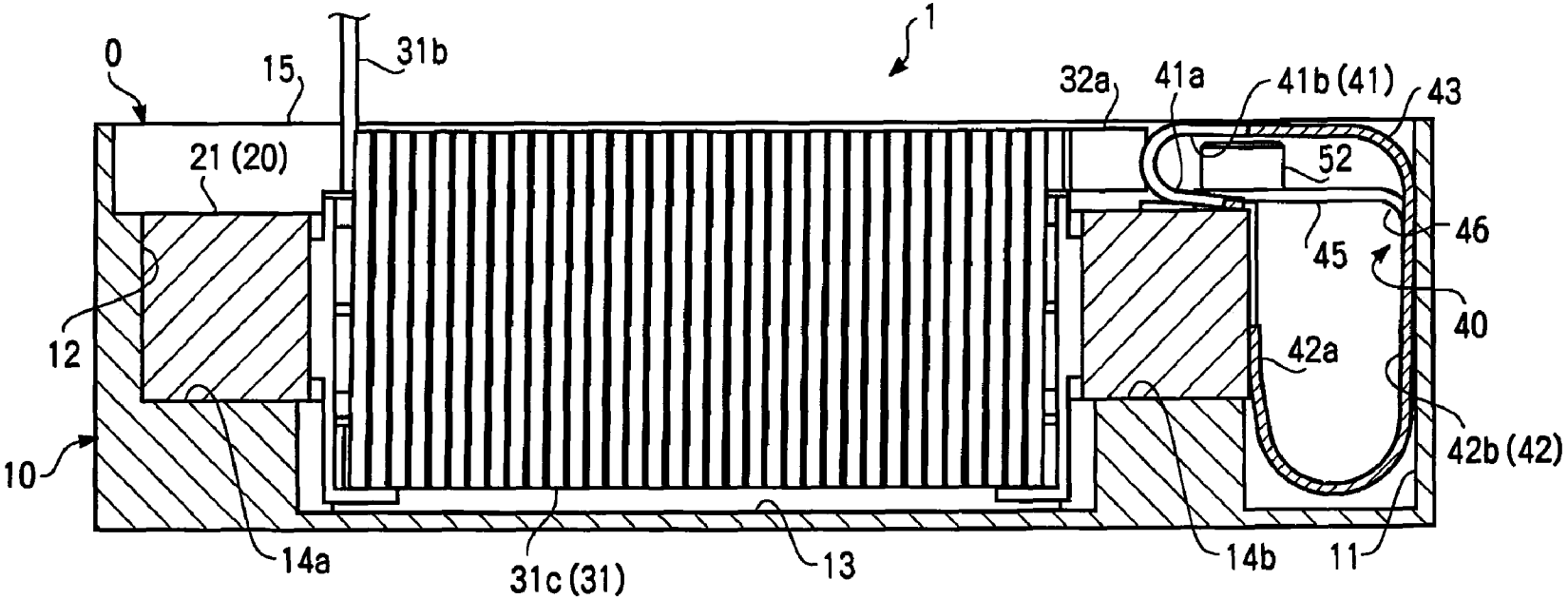
FIG. 2 is a cross-sectional side view showing the reactor according to the embodiment of the present invention.

FIG. 1 is a perspective view showing a reactor according to an embodiment of the present invention. FIG. 2 is a cross-sectional side view showing the reactor according to the embodiment of the present invention. A reactor 1, in an exemplary embodiment, is configured such that an approximately O-shaped core 20, which is O-shaped when viewed from directly above, and a pair of coils 31 and 32, which are wound around the core 20, are accommodated in a case 10, which is a box-shaped container, having an opening O on one of faces of the case 10. A first end 31*a* of the coil 31 and a first end 32*a* of the coil 32 are connected together and configure a serially-cascaded circuit as a whole. A second end portion 31*b* of the coil 31 and a second end portion 32*b* of the coil 32 respectively protrude outside the case 10 through the opening O. The reactor 1 is installed into an electric circuit by connecting the second end portions 31*b* and 32*b* to the electric circuit. A coil body 31*c* of the coil 31 and a coil body 32*c* of the coil 32 are accommodated in the case 10 without protruding except for the second end portions 31*b* and 32*b*.

Note that, in the following description, a horizontal direction and a vertical direction are defined according to an arrangement shown in FIG. 2, and an upper side of FIG. 2 is defined as a top side of the reactor 1, a right side of FIG. 2 is defined as a right side of the reactor 1. In addition, a virtual plane on the opening O is defined as a top plane.

In the exemplary embodiment, a fixing member 40 is used to fix the core 20, the coils 31 and 32 to the case 10. The fixing member 40 is formed by bending a metal plate such as stainless-steel plate into an L-shape at a first corner portion 43. In addition, a fore-end portion 41*a* of an upper plate 41, which extends from the first corner portion 43 in a horizontal direction, is downwardly bent into a U-shape so as to define a leaf spring. An incision 47 is formed on an area straddling the upper plate 41 and the fore-end portion 41*a* to adjust a spring force of the leaf spring. A fore-end portion 42*a* of a side plate 42, which extends from the first corner portion 43 in a vertical direction, is upwardly bent into a U-shape so as to define a leaf spring. The fixing member 40 is fixed to the case 10 with volts 52 and the side plate 42 is inserted into a space, which is relatively narrower than a thickness of the leaf spring formed by the side plate 42, between a right side wall 11 of the case 10 and the core 20. Thus, the side plate 42 bent into a U-shape is compressed in the space between the right side wall 11 of the case 10 and the core 20, and the fore-end portion 42*a* biases the core 20 toward a left side wall opposed to the right side wall 11.

The upper plate 41 of the fixing member 40 is arranged above the core 20, and the fore-end portion 41*a* bent downwardly elastically push-contacts a top surface of the core 20. Thus, when the fixing member 40 is fixed to the case 10, the top surface of the core 20 is pressed thereon with the fore-end portion 41*a* of the fixing member 40. At this time, a base portion 41*b* of the fixing member 40, the fore-end portion 41*a* of the fixing member 40 and the first corner portion 43 are upwardly deformed around a fulcrum point at which the fixing member 40 contacts with the right side wall 11. Thus, the core 20 is biased by a repulsion force of such deformations. The bottom surface 13 of the case 10 is provided with bumps 14*a* and 14*b* to support a bottom surface of the core 20, and the core 20 is pressed onto the bumps 14*a* and 14*b* because the fore-end portion 41*a* biases the core 20 toward the bumps 14*a* and 14*b*.

Thus, the core 20 is fixed to/retained in the case 10 so as not to move because the core 20 is biased into an inner surface 12 of the left side wall 12 and the bumps 14*a* and 14*b*

Figure 3:
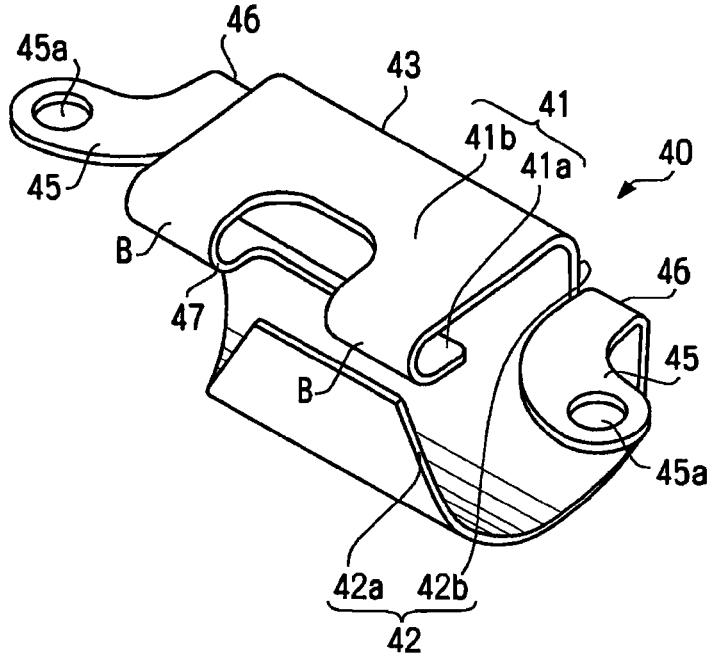
FIG. 3 is a perspective view showing a fixing member 40 used in the reactor from an anterior view of the FIG. 1.

Hereinafter, the details of the fixing member 40 are described. FIG. 3 is a perspective view showing the fixing member 40 from an anterior view of the FIG. 1, and FIG. 4 is a perspective view showing the fixing member 40 from a posterior view of the FIG. 1.

Figure 4:
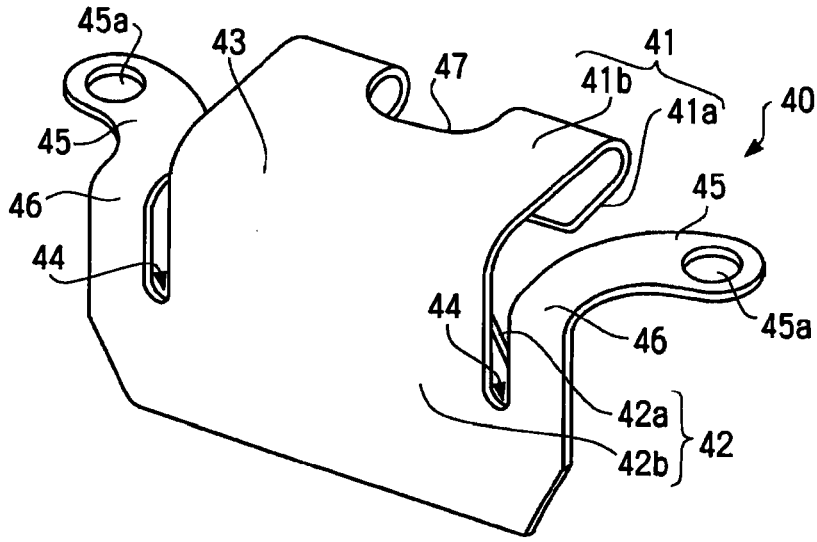
FIG. 4 is a perspective view showing the fixing member 40 used in the reactor from a posterior view of the FIG. 1.

As shown in FIG. 4, the fixing member 40 is provided with a pair of slits 44 which extend from both sides of the upper plate 41 to positions in the middle of the side plate 42. Namely, the upper plate 41 corresponds to a portion extended from a part of the side plate 42 between the slits 44. Fixing arms 45 for fixing the fixing member 40 to the case 10 (FIG. 1) with the bolts 52 are formed outside of both of the slits 44, i.e., the fixing arms 45 extends from a lower part of the side plate 42. In addition, each fixing arm 45 is formed by bending a portion outside of the slit 44 perpendicular to the side plate 42 at a second corner portion 46 which is lower than the first corner portion 43. Through-holes 45*a* are formed respectively at a fore-end portion of both of fixing arms 45, and the fixing member 40 is fixed to the case 10 by the bolts 52 through the through-holes 45*a*.

Figure 5:
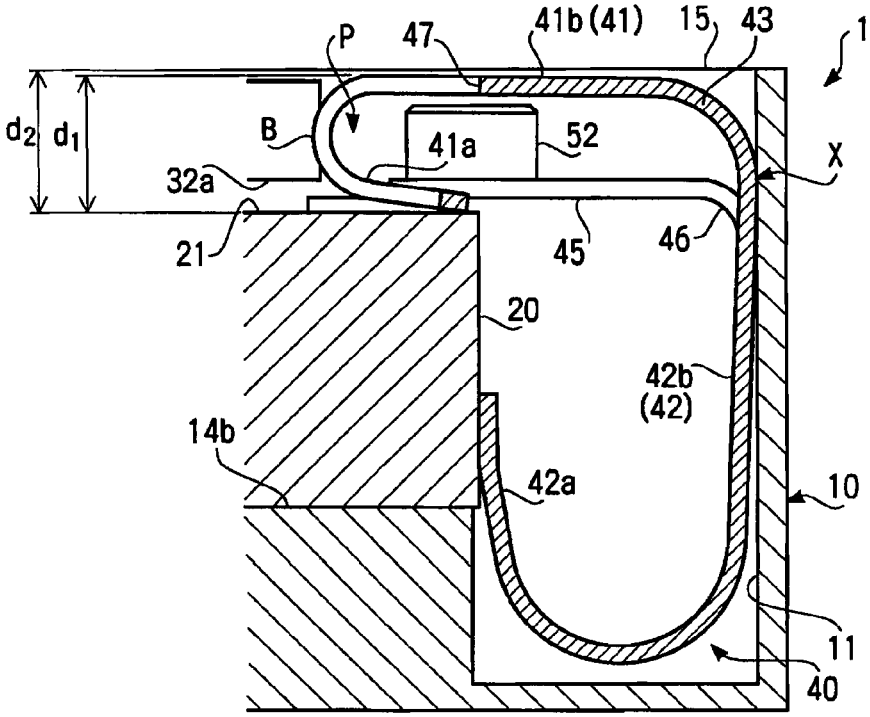
FIG. 5 is a cross-sectional side view showing configurations around the fixing member 40 used in the reactor according to the embodiment of the present invention.

FIG. 5 is a cross-sectional side view showing configurations around the fixing member 40 at a state where the core 20, the coil 31, the coil 32, and the fixing member 40 fixed to the case 10 with the bolts 52 are accommodated in the case 10. In the exemplary embodiment, the fixing member 40 is inserted to a space between the right wall 11 and the core 20 and contacts with the right side wall 11 at a fulcrum point X which is located around the first corner portion 43 on the side plate 42. Note that, as shown in FIG. 4, the slits 44 extend to the positions, which are lower than the fulcrum point X, in the middle of the side plate 42.

In such a case, when an impact load is given to the reactor 1, a major load is upwardly given to the fore-end portion 41*a* of the upper plate 41. A behavior of the fixing member 40 in such a case is described below. FIG. 6 is a cross-sectional side view showing a configuration around the fixing member 40 and also illustrating (1) a state where an external load from outside of the reactor 1 is not given to the fore-end portion 41*a* in solid line, and (2) a state where an external load from outside of the reactor 1 is given to the fore-end portion 41*a* in dashed line.

As shown in FIG. 6, when an upward load is given to the fore-end portion 41*a*, the fore-end portion 41*a* and a flection portion B are deformed because the fore-end portion 41*a* is bent in a direction toward the base portion 41*b* (deformation $\alpha$), and then the base portion 41*b* warps upwardly and the first corner portion 43 deformed because the fore-end portion 41*a* and a flection portion B are deformed (deformation $\beta$), and the first corner portion 43 warps upwardly (deformation $\gamma$). As described above, in the exemplary embodiment, when an upward load is given to the fore-end portion 41*a*, three kinds of deformations $\alpha$, $\beta$, and $\gamma$ are caused. Therefore, a deformation volume of each of deformations $\alpha$, $\beta$, and $\gamma$ is kept low. In other words, in the fixing member 40 according to the exemplary embodiment, the fore-end portion 41*a* (deformation $\alpha$), the flection portion B (deformation $\alpha$), the base portion 41*b* (deformation $\beta$) and the first corner portion 43 (deformation $\beta$ and $\gamma$) respectively function as leaf springs against a load externally given to the fore-end portion 41*a* upwardly. Thus, a stress concentration to the fixing member 40 is absorbed, and the fixing member 40 becomes to be irrefrangible even if an impact load is given to the reactor 1.

In general, the stress concentration is incident on the end of a cutout portion such as slit end, but the slits 44 according to the exemplary embodiment exceed the fulcrum point X and extend to positions in the middle of the side plate 42. Since an impact load is supported to the case 10, i.e., at the fulcrum X, the impact load is scarcely given to a portion which is lower than the fulcrum point X. Therefore, an excessive stress concentration is not caused at the ends of the slits 44.

As described above, the coil body 31*c* and the coil body 32*c* are accommodated in the case 10 without protruding. Therefore, a space P is secured between the case 15 and the top surface 21 of the core 20. As shown in FIG. 5, when the fixing member 40 is fixed to the case 10, a spacing d1 from the top surface of the core 20 to a top end of the upper plate 40 and a spacing d2 from the top surface of the core 20 to a top end 15 of the case 10 are almost the same. In other words, in the exemplary embodiment, a spacing from the top surface of the core to a top surface of the coil body 31*c* and 32*c* is approximately equal to a spacing from the fore-end portion 41*a* to the base portion 41*b*. Thus, when the fixing member 40 is fixed to the case 10, the upper plate 41 of the fixing member 40 is accommodated in the space P without protruding the top end of the fixing member 40 from the case 10. In other words, the reactor 1 according to the exemplary embodiment allows the fixing member, which is superior in an impact resistance, to be used without making the case 10 larger by using the space P effectively.

What is claimed is:

1. An inductor comprising:

a case having an opening;

a core accommodated in the case;

a coil wound on a part of the core; and a fixing member fixed to the case and configured to fix the core by contacting a top surface of the core facing the opening and elastically biasing the core toward a bottom surface of the case;

the fixing member including:

a first plate portion being disposed between the top surface of the core and the opening of the case while facing the opening of the case and extending in parallel with the top surface of the core; and a first contacting portion extending from a fore-end portion of the first plate portion so as to be U-shaped and having a distal end portion elastically push-contacting the top surface of the core.

2. The inductor according to claim 1, wherein the fixing member further includes a fixing portion to fix the fixing member to the case, and wherein a slit is formed between the fixing portion and the first plate portion.

3. The inductor according to claim 1, wherein the fixing member further includes a second plate portion extending from one end of the first plate portion such that the fixing member becomes L-shaped and the second plate portion is inserted into a space between the core and an inner surface of a side wall of the case, and wherein a slit extends to the middle of the second plate portion.

4. The inductor according to claim 3, wherein the second plate portion is bent into a U-shape, and wherein a second contacting portion formed at a fore-end portion of the second plate portion elastically push-contacts one side surface of the core and biases the core toward an inner surface of a side wall contacting with the other side surface of the core.

5. The inductor according to claim 2, wherein the fixing portion includes a pair of arms formed on the sides of first plate portion, and wherein slits are formed respectively between each of the pair of arms and the first plate portion.

6. The inductor according to claim 1, wherein an incision is formed on an area straddling the first plate portion and the first contacting portion.

7. The inductor according to claim 1, wherein a spacing from the top surface of the core to an outer circumference of the coil is substantially equal to a spacing from the first plate portion of the fixing member to the first contacting portion of the fixing member.

8. The inductor of claim 7, wherein the spacing from the top surface of the core to an outer circumference of the coil extends in a parallel direction with the spacing from the first plate portion of the fixing member to the first contacting portion of the fixing member.

* * * * *